US010320109B2

(12) United States Patent
Drake et al.

(10) Patent No.: US 10,320,109 B2
(45) Date of Patent: Jun. 11, 2019

(54) CABLE TERMINATOR

(71) Applicant: Level 3 Communications, LLC, Broomfield, CO (US)

(72) Inventors: Steven Drake, Thornton, CO (US); Luke Pearse, Westminster, CO (US)

(73) Assignee: Level 3 Communications, LLC, Broomfield, CO (US)

( * ) Notice: Subject to any disclaimer, the term of this patent is extended or adjusted under 35 U.S.C. 154(b) by 852 days.

(21) Appl. No.: 14/248,657

(22) Filed: Apr. 9, 2014

(65) Prior Publication Data

US 2015/0295338 A1 Oct. 15, 2015

(51) Int. Cl.

*H01R 13/44* (2006.01)
*H01R 13/443* (2006.01)
*H01R 13/60* (2006.01)

(52) U.S. Cl.

CPC ..... *H01R 13/443* (2013.01); *H01R 13/60* (2013.01); *H01R 2201/04* (2013.01)

(58) Field of Classification Search

CPC .. G02B 6/3825; G02B 6/3897; H01R 13/443; H01R 13/44; H01R 13/60; H01R 2011/04
USPC ..... 385/75–78
See application file for complete search history.

(56) References Cited

U.S. PATENT DOCUMENTS 6,102,581 A * 8/2000 Deveau ..... G02B 6/266 385/139
7,387,447 B2 * 6/2008 Mudd ..... G02B 6/3825 385/53
7,703,987 B2 * 4/2010 Kramer ..... G02B 6/3825 385/53
7,985,027 B2 * 7/2011 Lewallen ..... G02B 6/3831 385/60
8,038,456 B1 * 10/2011 Wang ..... G02B 6/3893 385/56
8,137,003 B2 * 3/2012 Shannon ..... G02B 6/4246 385/53
8,408,815 B2 * 4/2013 Lin ..... G02B 6/3825 385/76
8,419,291 B2 * 4/2013 Koreeda ..... G02B 6/3825 385/56
2008/0069501 A1 * 3/2008 Mudd ..... G02B 6/3825 385/75

* cited by examiner

*Primary Examiner* — Xuong M Chung Trans

(57) ABSTRACT

Implementations of the present disclosure involve a cable terminator and/or method of using a cable terminator for non-operably securing a network cable at a destination port on a network device. The cable terminator has a body that includes an insert portion and a receiving portion. The insert portion is shaped so that it may be inserted into a port on a network device, while the receiving portion is shaped to receive a network cable.

11 Claims, 5 Drawing Sheets

CABLE TERMINATOR

FIELD OF THE DISCLOSURE

Aspects of the present disclosure relate to a network cable terminator for attaching a network cable at a port on a network device.

BACKGROUND

Telecommunications networks include a variety of computing devices for providing various services. For example, servers, routers, switches and various associated components, such as networking cables, are used for operating networks. Data centers, which are dedicated to housing networking and computing devices and associated components have been constructed to serve computing and telecommunication various networks and Internet as a whole.

Networking, telecommunications and computing devices (collectively "network devices") are generally mounted in racks in data centers, with each rack housing up to dozens of network devices. Each network device may in turn have multiple network connections. Thus, each rack may have large numbers of network cables running to/from the rack. A rack unit, referred to as a U or RU, is a standard unit of measure that describes the height of network devices. Generally speaking, a standard 19 inch rack has 42 U of device space. A 1 U switch may have upwards of 48 ports for connecting Ethernet, fiber optic, or other networking cables. A standard 19" rack filled with 48 port 1U switches may have up to 2016 ports and 2016 cables running to it. As the number of cables running through a data center increase, the importance of cable management also increases.

When installing new racks in a data center, cables are often run to racks before the networking devices have been installed or are fully operational. In many cases, network cables can only be installed once the network device is operating. Networked devices often include ports for connecting hot-pluggable transceivers for network communications. The transceivers plug into a port on the network device, receive a network cable, and allow for network communications. Small form-factor pluggable (SFP) devices are compact transceivers that are commonly used in data and telecommunications. SFPs interface with the motherboard of a network device and either a fiber optic or copper networking cable (i.e. Ethernet cables). Common SFP transceivers support Synchronous Optical Networking (SONET), Ethernet, and Fibre Channel. Additional transceiver standards include enhanced small form-factor pluggable (SFP+), 10 gigabit small form factor pluggable (XFP), Quad small form-factor pluggable (QSFP), and gigabit interface converter (GBIC). The different transceivers generally have different physical dimensions and a port on a network device doesn't necessarily accept all of the standards. In some cases, the network device's transceivers have not yet been installed, but the cables that will eventually be connected to the transceivers have already been run to the rack.

When network cables cannot be attached to their designated port, the cables are often hung on the server rack or coiled onto the floor. When it's time to install the cables, the installer often must deal with a multiple unattached cables and determine where the cables should be installed. It is with these and other issues in mind that various aspects of the present disclosure were developed.

SUMMARY

According to one aspect, a cable terminator is provided for securing networking or other cables at locations on network devices in substantial proximity to where the cables will ultimately be connected to a network device. The cable terminator securely connects to an open port on the network device and accepts and securely holds a terminated network cable, such as a LC terminated fiber optic cable or RJ45 Ethernet cable. The open port may include an open transceiver slot or an open port on the transceiver. The cable terminator may also include tapered sides that allow the cable terminator to be placed in different sized transceiver ports. The cable terminator may be configured to not only hold the cable at the appropriate port, but to also block dust and/or debris from entering the port and generally protecting the port and cable termination from damage.

The cable terminator includes an insert portion configured to be inserted into a port on a network device. The cable terminator is secured at the port by friction between the insert portion and the port. The cable terminator also includes a receiving portion with a socket. The socket is configured to receive and secure the terminal of a network cable.

BRIEF DESCRIPTION OF THE DRAWINGS

Aspects of the present disclosure may be better understood and its numerous objects, features, and advantages made apparent to those skilled in the art by referencing the accompanying drawings. It should be understood that these drawings depict only typical embodiments of the present disclosure and, therefore, are not to be considered limiting in scope.

DETAILED DESCRIPTION

Implementations of the present disclosure involve a cable terminator used to aid in the management of cables, often fiber, within a computing environment like a data center. The cable terminator is configured to attach to a network device port or transceiver occupying a port and providing a terminal or terminals for connecting a network cable. The cable terminator allows for cables to be connected at a port without having an operating connection between the cable and the network device. The cable terminator also functions as a dust and debris cap for the network device port and for network cables.

Figure 1:
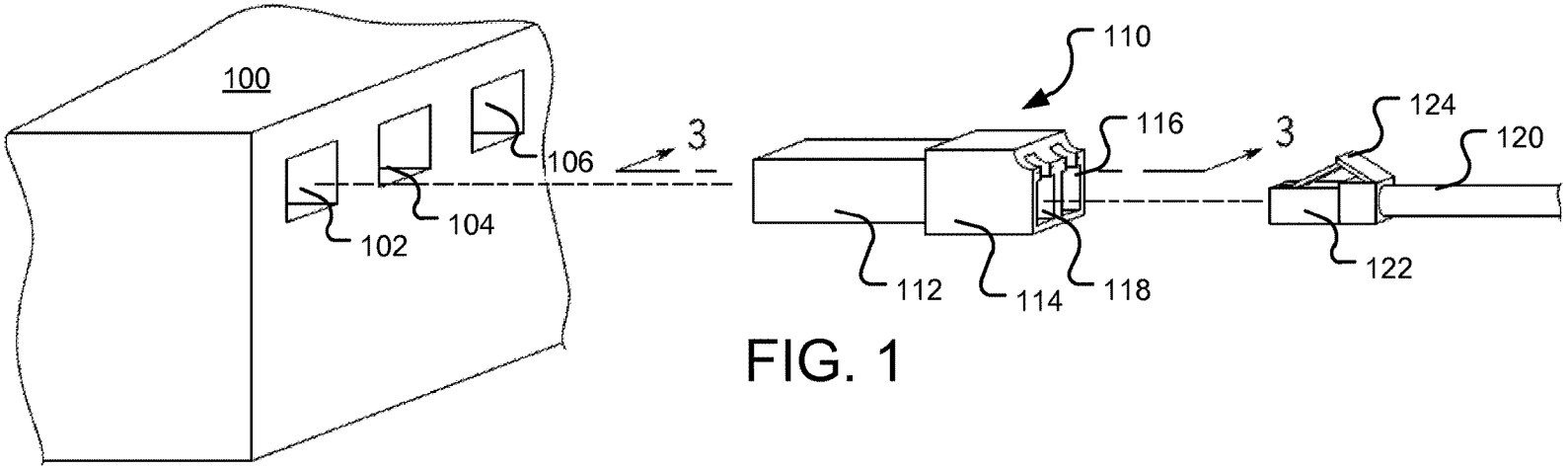
FIG. 1 depicts a networked device, a cable terminator, and an LC terminated fiber optic cable.

Referring to FIG. 1, a cable terminator 110 prior to being installed is depicted. In this example, a network device 100 includes three ports 102, 104, 106 for receiving and connecting transceivers (not depicted). The network device 100 may include any type of network enabled device. For example, the network device 100 may be a server, a switch, a network attached storage (NAS), a router, telecommunications equipment, or any other device to which the cable may be connected. In some cases, the network device 100 may also be configured with built-in ports for accepting specific networking connections such as LC-type fiber optic connections or RJ45 copper based Ethernet connections.

The ports 102-106 are sized according to a standard transceiver size. For example, the ports 102-106 may be configured to receive SFP transceivers for fiber optic, Ethernet, or other network communications. The ports 102-106 generally include an opening in the case of the network device with a motherboard connection for providing an interface between the transceiver and the network device 100. Generally, the motherboard connection is located towards the back of the port 102-106, inside of the network device 100.

The cable terminator 110 has a body that is divided into an insert portion 112 and a receiving portion 114. The cable terminator 110 is configured to fit into an open port 102-106 and provide a socket 116, 118 for attaching a network cable 120. The cable terminator 110 may also effectively function as a dust cap for the ports 102-106 or a transceiver installed in one of the ports 102-106, as well as the end of the network cable 120. The cable terminator 110 may attach to the port 102, by being inserted into the port. The body of the cable terminator 110 includes an insert portion 112 that is configured to fit into the port 102-106, and a receiving portion 114 that protrudes from the network device 100 and includes at least one socket 116, 118 for terminating a network cable 120.

The insert portion 112 is shaped to allow for the cable terminator 110 to be fitted to an open port 102-106 on the network device 100. The insert portion 112 is configured to be placed into a port 102-106 and may be secured by friction and/or an attachment mechanism such as springs, clips, tangs, or other attachment devices for securing the cable terminator 110 at the port 102-106. In alternate embodiments described below, the cable terminator 110 is configured to be inserted into a transceiver that has been installed in a port.

Figure 3:
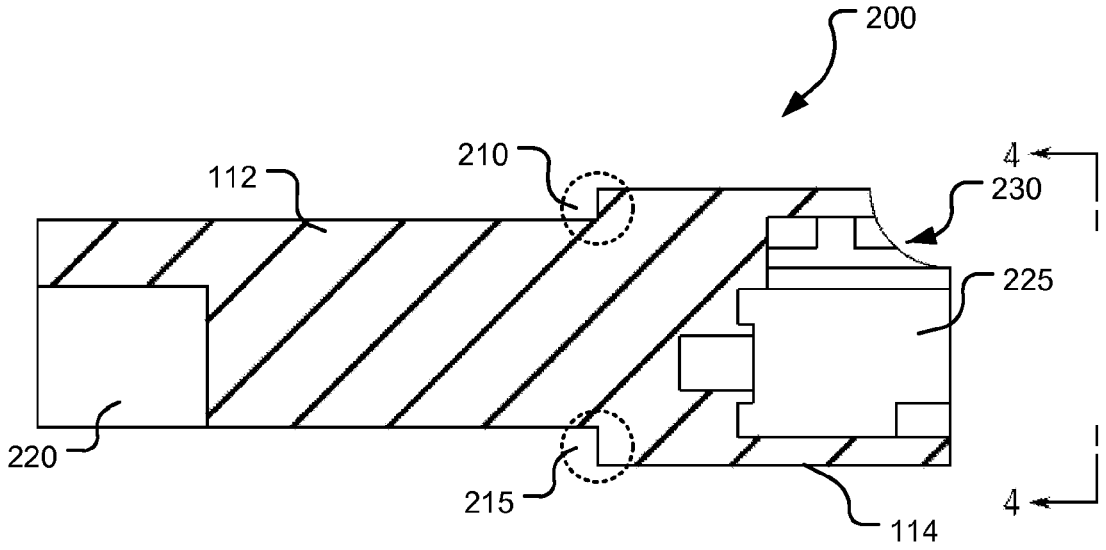
FIG. 3 depicts an internal view of a cable terminator.
Figure 4:
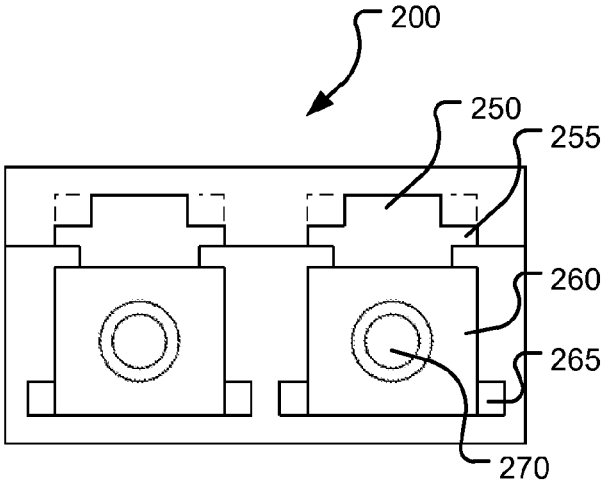
FIG. 4 depicts an end view of a cable terminator.

The receiving portion 114 of the cable terminator 110 is shaped includes at least one socket 116, 118 for securing a network cable 120 to the cable terminator 110. The socket 116, 118 mirrors the configuration of a functioning terminal for the network cable 120. For example, the cable terminator 110 may include two sockets 116, 118 that are configured to receive LC-type fiber optic connectors. As such, the sockets 116, 118 are configured to mirror a traditional LC-type fiber optic connector port as shown in FIGS. 3 and 4 and discussed below.

In this example, the network cable 120 has a LC-type fiber optic connector 122. The network cable 120 includes an LC-type fiber optic connector 122 that has a generally rectangular shape and a retaining tab 124 located at the top of the fiber optic connector 122. In other examples, the network cable 120 may be terminated using another type of termination. For example, the network cable 120 may be terminated using a St, SC, FC, MT-RJ, or any other type of fiber optic connector. In other instances, the network cable may include a copper-based network cable such as an Ethernet cable. An embodiment of a cable terminator configured to interface with RJ45 Ethernet cable connectors is described below with reference to FIG. 12. In the case of a different type of connector, the sockets 116, 118 may be modified or replaced with a corresponding receiver for the connector being used.

Figure 2:
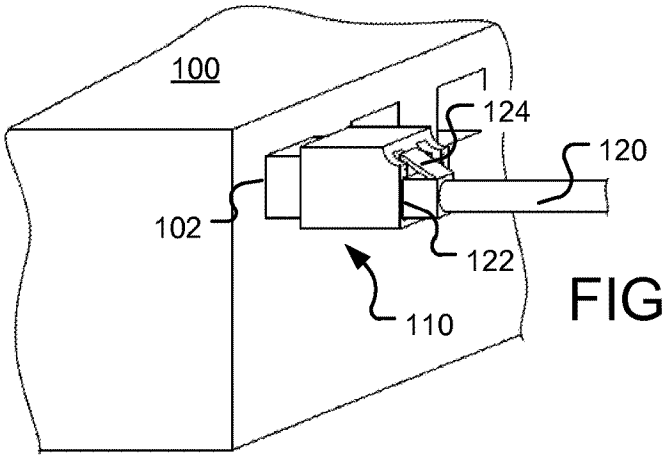
FIG. 2 depicts a networked device, an installed cable terminator, and an LC terminated fiber optic cable.

Referring now to FIG. 2, an installed cable terminator 110 is depicted, with a fiber 120 terminated at the terminator 110. In this example, the insert portion 112 has been inserted into the previously empty port 102. The insert portion 112 may be constructed to substantially mimic a standard transceiver so that it may be inserted into the port 102. Thus, the insert portion 112 has a general rectangular prism shape. In another embodiment, discussed below with reference to FIGS. 5 and 6, the insert portion 112 may be configured with a clipping mechanism that is fit into the port 102. The insert portion 112 may also be constructed of pliable and/or compressible materials, such as rubber or plastic. The insert portion 112 of the cable terminator 110 may fit snugly in into the port 102. In some cases, the cable terminator 110 may be constructed with a pliable material that may be may be flexed, stretched, or compressed to fit into the port 102, resulting in a secure fit.

In addition to the cable terminator 110 being installed into the port 102, the LC-type fiber optic connector 122 of the network cable 120 has been inserted in to the receiving portion 114. The LC-type fiber optic connector 112 includes a retaining tab 124 that snaps into corresponding slot in the socket 116, securing the LC-type fiber optic connector 122 to the socket 116. The network cable 120 is fixed to the cable terminator 110 unless pressure is applied to the retaining tab 124. Once pressure is applied to the retaining tab 124, the LC-type fiber optic connector 122 may be removed from cable terminator.

Referring to FIG. 3 a side section of a cable terminator 200 is depicted. The cable terminator 200 has dimensions that are similar to a standard transceiver. For example, a standard SFP transceiver has a height of 8.5 mm, width of 13.4 mm, and a length of 56.5 mm. A standard XFP transceiver, on the other hand, has a height of 8.5 mm, width of 18.35 mm, and a length of 78.0 mm. Thus, the width and height of the cable terminator 200 may be varied to be equivalent to a transceiver standard being used on a network device. In some cases, the depth of the cable terminator 200 may be shorter than the standard transceiver depth. For example, a standard SFP transceiver has a depth of 56.5 mm, but the cable terminator 200 may be shorter, but long enough for the cable terminator 200 to be securely attached at the port.

The receiving portion 114 of the cable terminator 200 may have different dimensions than the insert portion 112. For example, the receiving portion 114 may have a greater height and/or width than the insert portion 112. The differing sizes between the insert and receiving portions forms ridges 210, 215. The ridges 210, 215 prevent the cable terminator 200 from being inserted too far into an open port and may help insure that the cable terminator 200 does not interfere with functional elements operating in the port.

The cable terminator 200 also includes one or more cutouts 220 to prevent the cable terminator 200 from coming in contact with functional elements located inside of a port. Functional elements may include electrical, optical, and/or mechanical components located inside the port. For example, as discussed above, ports generally include a connector to a motherboard or other component of the network device 100. The cable terminator 200 may include cutouts for accommodating the connector, but not forming any functional electrical connection to the connector since the cable terminator 200 is not required to connect to an electrical circuit of the network device. In one implementation, the cable terminator 200 may include circuitry and an electrical connection configured to indicate the cable terminator's model and connection type and may be provisionable with fiber type and end fiber location.

The cable terminator 200 also includes a socket 225 for housing the terminal of a network cable. The socket 225 is shaped according to the type of connector being used and includes any grooves, notches or cutouts used by a conventional terminal for receiving the connector. In this example, the socket 225 is configured to accept a LC-type fiber optic connector 122, and includes space for the LC-type fiber optic connector and therefore includes a notch or notches for accommodating the LC-type fiber optic connector.

Referring to FIG. 4, an end view of the cable terminator 200 is depicted. From this perspective, the general shape of the socket 225 is shown. As discussed above, the depicted cable terminator 200 is configured to connect to an LC-type fiber optic connector. Thus, the cable terminator has cutouts 250, 255, 260, 265 to allow for a LC-type fiber optic connector to be inserted and secured. The cable terminator 200 also includes a fiber optic cutout 270 for fiber optic cable protruding from the network cable.

Figure 5:
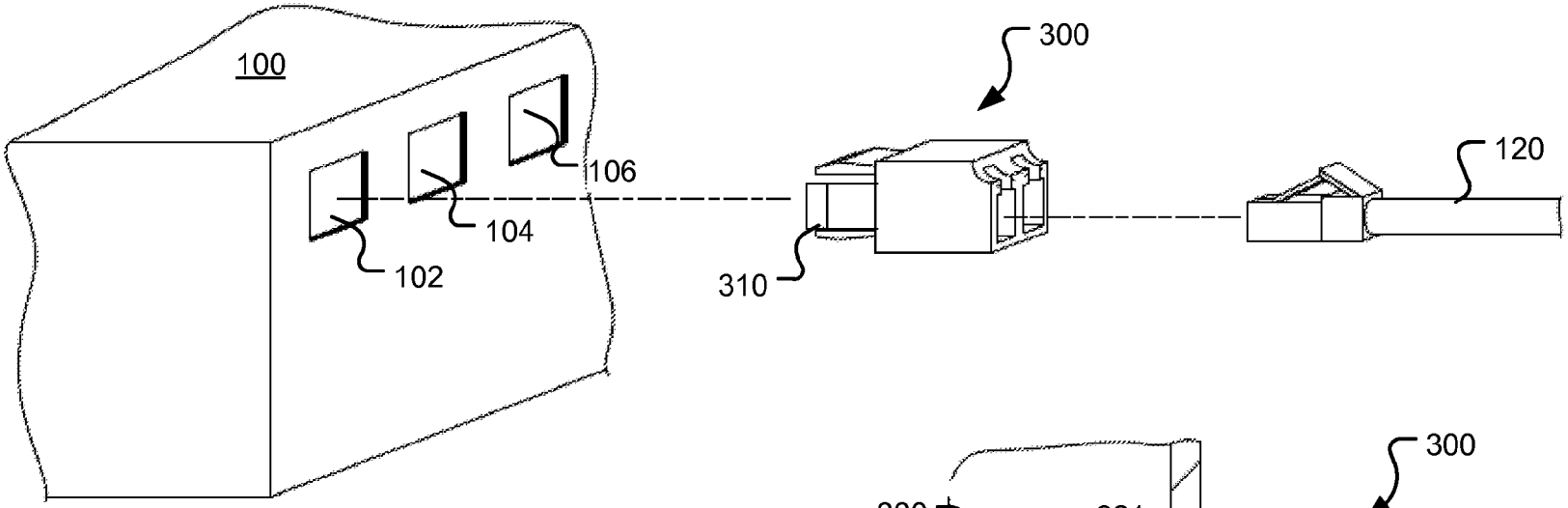
FIG. 5 depicts an alternative embodiment of a cable terminator.
Figure 6:
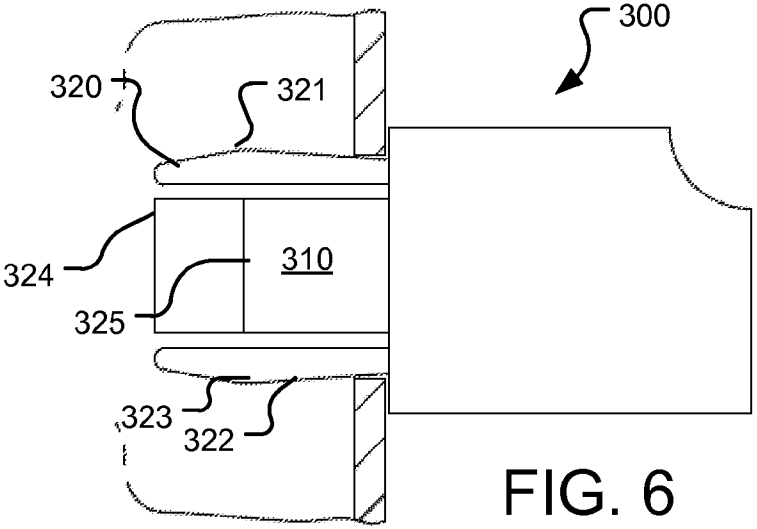
FIG. 6 depicts an installed alternative embodiment of a cable terminator

Referring to FIGS. 5 and 6, an alternative embodiment of a cable terminator 300 is depicted. The cable terminator 300 includes a clipping insert portion 310 that securely attaches the cable terminator 300 to the port 102. The clipping insert portion 310 is generally rectangular in shape and sized to fit into an open port with no transceiver installed. The clipping inner portion includes at least one angled tang 320, 322, 324. The tangs 320, 322, 324 featured an angled edge that varies in height along the length of the tang. The tip of each tang is configured with a smaller height so that the tang easily fits in the port 102. The height of the tang increases along the length of the tang, until the reaching a maximum height 321, 323, 325 that results in the overall dimensions of the clipping insert portion 310 to be larger than the height and/or the width of the port 102. The height of the tang then decreases until the end of the clipping insert portion 310. In operation, the tangs 320, 322, 324 are somewhat flexible, and when the clipping insert portion 310 is pushed into the open port 102, the angled tangs 320 are deflected inwards and then substantially return to their original position as the tang height is decreased, forming an interference fit. The depicted cable terminator 300 includes four tangs 320, 322, 324 arranged in a rectangular pattern. It should be understood that the positioning and dimensions of the tangs may be modified for use with various port sizes. Furthermore, not all tangs need to be angled to achieve the described interference fit.

Figure 7:
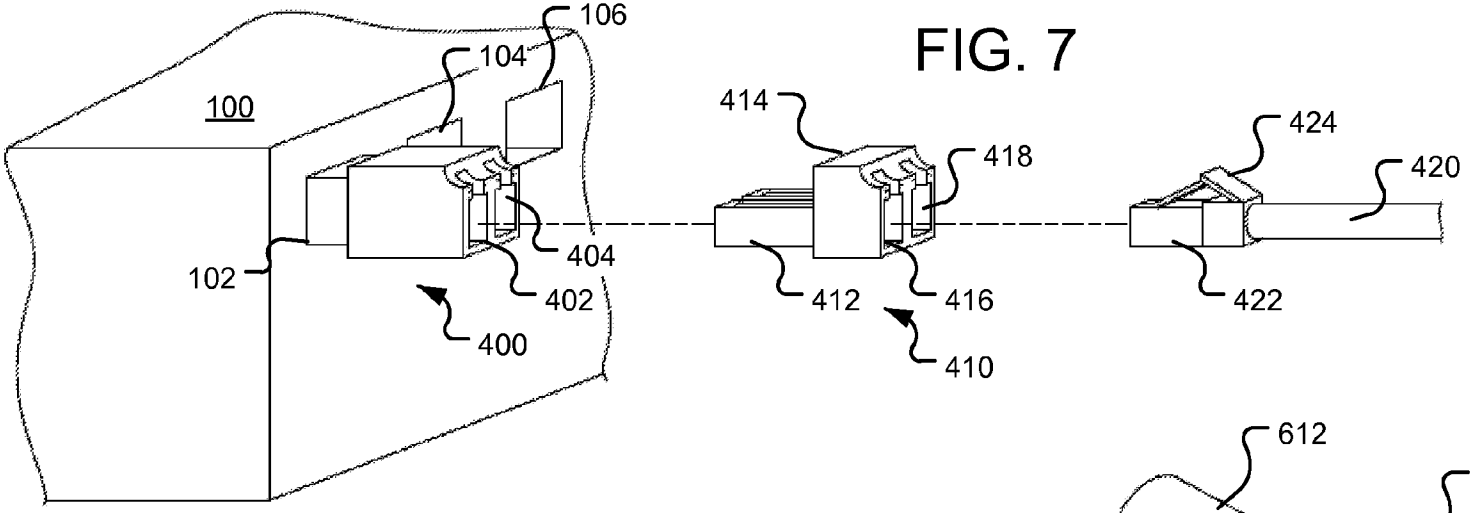
FIG. 7 depicts a network device, a SFP transceiver, a cable terminator, and an LC terminated fiber optic cable.

Referring now to FIG. 7, a network device 100 with an installed transceiver 400 is depicted. In an alternative embodiment, the cable terminator 410 is configured to be inserted into a transceiver port 402, 404 instead of into a network device port 102-106. In this embodiment, the receiving portion includes sockets 416, 418 for receiving a conventionally terminated network cable similar to the above described sockets. In this example, the cable terminator 410 has been modified to interface with the transceiver 400 by having an insert portion 412 that defines a rectangular prism shaped member that is sized and shaped similar to a conventional cable connector 422. Thus, the insert portion 412 may be inserted into the transceiver port 402, 404. In many cases, the insert portion 412 is not an exact replica of the type of connector used by the cable 420. For example, the insert portion 412 may not necessarily include the retaining clip 424 that is included in the connector 422. The insert portion 412 is generally similar enough to the connector 422 to be inserted and secured in the cable terminator 410. Furthermore, the cable terminator 410 may also constructed using a pliable material that allow for the insert portion 412 to be snugly inserted into the transceiver port 402, 404.

Figure 9:
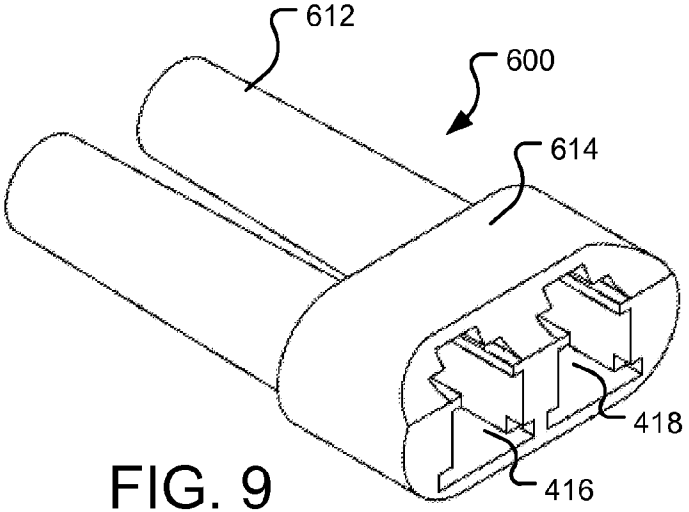
FIG. 9 depicts an alternative embodiment of a cable terminator.
Figure 8:
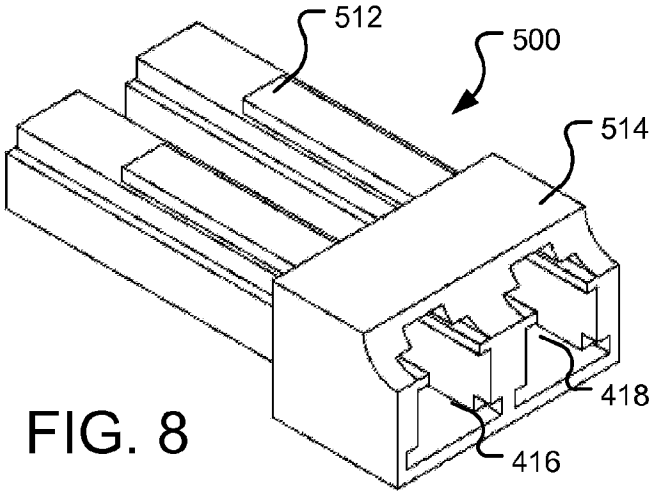
FIG. 8 depicts an alternative embodiment of a cable terminator.

Referring to FIGS. 8 and 9, alternative embodiments of cable terminators configured to be fit into LC-type fiber optic transceivers are depicted. The first cable terminator 500 has an insert portion 512 that more closely mimics an LC-type fiber optic connector and may be inserted into a LC-type fiber optic transceiver. The second cable terminator 600 has an insert portion 612 that is generally cylindrical in shape and may also be inserted into a LC-type fiber optic transceiver. In either case, the insert portions 512, 612 are able to secure the cable terminators 500, 600 to the transceiver. Both the first and the second cable terminators 500, 600 may include openings at the ends of the insert portion to accommodate a functional element of a transceiver. For example, the openings may be cylindrically shaped and configured to wrap around an optical connection inside of an LC-type fiber optic transceiver. The shape of the receiving portion 514, 614 may be modified to be any shape that still allows for the inclusion of the sockets 416, 418.

Figure 10:
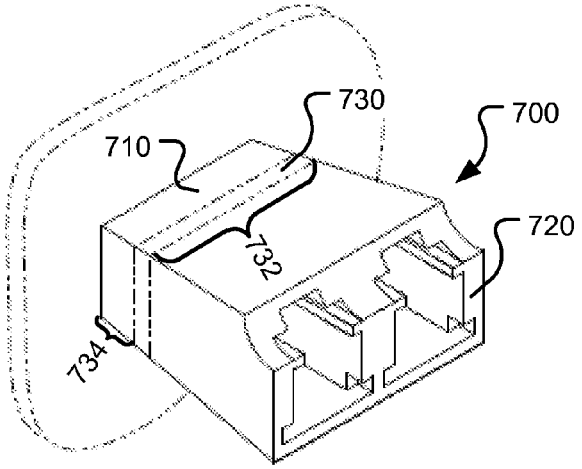
FIG. 10 depicts a universal cable terminator and a network device with a small port size.
Figure 11:
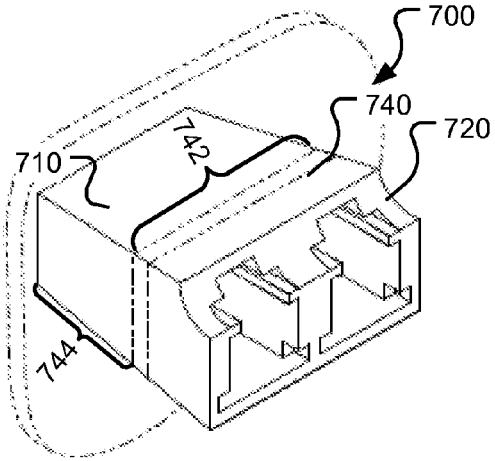
FIG. 11 depicts a universal cable terminator and a network device with a large port size.

Referring now to FIGS. 10 and 11, a universal cable terminator 700 is depicted. As discussed above, a network device has ports that are sized according to the transceiver standards being utilized by a network device. The universal cable terminator 700 is configured with at least one tapered side so that it may be inserted into ports with varying dimensions. FIG. 10 includes a first port 730 with a first width 732. FIG. 11 includes a second port 740 with a second width 742 that is wider than the first width 732. The insert portion 710 starts with a smaller end and expands in width as defined by two tapered sides. The tapered sides of the universal cable terminator 700 continuously expand as they reach the receiving portion 720.

The universal cable terminator 700 may be inserted into variously sized open ports by engaging the port sides along the tapered sides. Depending on the port dimensions, the depth that the universal cable terminator 700 is inserted into the port varies. For example, FIG. 10 includes the first port 730 having a relatively small first a relatively small first width 732. The universal cable terminator 700 may be inserted into the port 730 until the tapered sides engage the port 730. The result is the universal cable terminator 700 is inserted a first depth 734 into the port 730. In FIG. 11, the second port 740 has a relatively wide port having the second width 742. The universal cable terminator 700 is also secured by the tapered sides engaging the port 740. In this case, the universal cable terminator 740 has been inserted a second depth 744 into the port 740.

In one possible example, the tapering of the sides may be selected according to the dimensions of two or more transceiver standards. For example, a standard SFP transceiver is 8.5 mm×13.4 mm×56.5 mm, and a depth of 56.5 mm, while a standard XFP transceiver is 8.5 mm×18.35 mm×78.0 mm. To accommodate fitting into both of these standards, the universal cable terminator may have a height of 8.5 mm, but the width may start at less than 13.4 mm and expand to 18.35 mm. The length of the universal cable terminator is less than 78.0 mm. Thus, the universal cable terminator may be inserted into both SFP and XFP transceiver ports.

Figure 12:
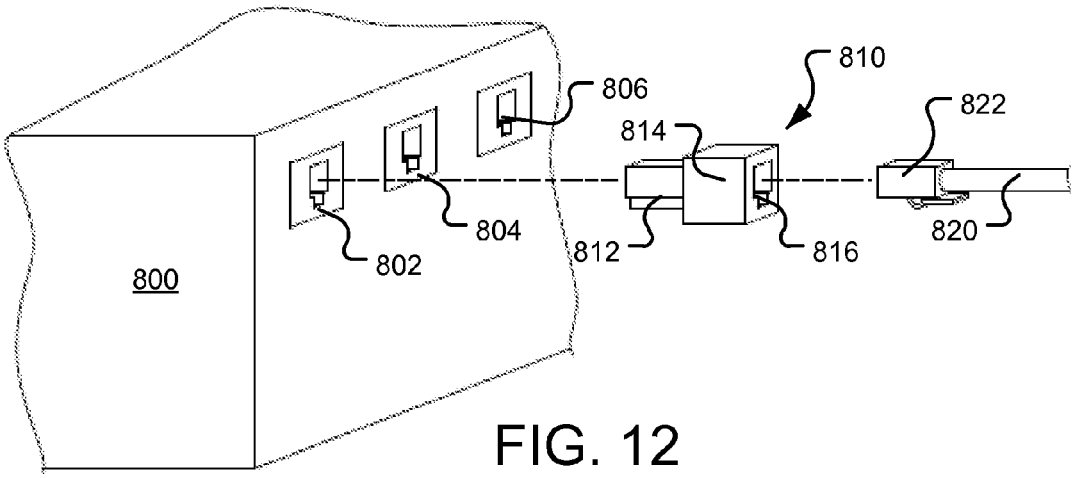
FIG. 12 depicts a networked device, an Ethernet cable terminator, and a RJ45 terminated Ethernet cable.

Referring to FIG. 12, an Ethernet cable terminator 810 configured to interface with RJ45 Ethernet-type connector is depicted. The cable terminator may be modified to interface with any type of cable or cable terminal. In this example, the network device 800 has multiple Ethernet connections 802, 804, 806. The Ethernet connections 802-806 may be permanent connections on the network device 800, transceivers that are occupying transceiver ports on the network device 800, or empty transceiver ports on the network device 800. The Ethernet cable terminator 810 includes an insert portion 812 that is configured to interface with an RJ45 Ethernet-type socket. Likewise, the receiving portion 814 has been modified with a socket 816 configured to operate similar to a RJ45 Ethernet-type socket and accept and secure an Ethernet cable. Similar to the above described cable terminators, the Ethernet cable terminator 810 may be inserted into the RJ45 port 802-806 on the network device 800 that the network cable 820 will eventually be connected to. The RJ45-type connector of the Ethernet cable 820 is then inserted into socket 816.

The foregoing merely illustrates the principles of the cable terminator. Various modifications and alterations to the described embodiments will be apparent to those skilled in the art in view of the teachings herein. It will thus be appreciated that those skilled in the art will be able to devise numerous systems, arrangements and methods which, although not explicitly shown or described herein, embody the principles of the described apparatus and are thus within the spirit and scope of the present disclosure. From the above description and drawings, it will be understood by those of ordinary skill in the art that the particular embodiments shown and described are for purposes of illustrations only and are not intended to limit the scope of the present disclosure. References to details of particular embodiments are not intended to limit the scope of the disclosure.

What is claimed is:

1. A cable terminator comprising:

a body having an insert portion coupled to a receiving portion, wherein:

the insert portion being shaped to be inserted into a port on a network device;

the receiving portion being shaped to receive a network cable and hold the network cable in place, wherein the receiving portion has a larger cross section than the insert portion where the insert portion is coupled to the receiving portion to create at least one ridge to prevent the receiving portion from being inserted into the port; and the body being configured to prevent an operating connection between the network cable and the network device.

2. A cable terminator of claim 1, wherein the insert portion defines a rectangular prism shaped member sized substantially similar to a conventional operable connector but to not interfere with a functional element in the port.

3. A cable terminator of claim 1, wherein the receiving portion defines at least one socket, the socket substantially replicating a network cable socket and preventing an operating connection between the network cable and the network device.

4. The cable terminator of claim 2, wherein the rectangular prism shape has substantially similar dimensions to a transceiver.

5. The cable terminator of claim 3, wherein the at least one socket is shaped substantially similar to a LC-type socket.

6. The cable terminator of claim 2, wherein the member is configured to be received by a LC-type socket.

7. A cable terminator comprising:

a body comprising an insert portion coupled to a receiving portion, wherein:

the insert portion being shaped to be inserted into a port on a network device, the insert portion comprising at least one member sized substantially similar to a conventional operable connector but to not interfere with a functional element in the port; and the receiving portion being shaped to receive a network cable and hold the network cable in place, wherein the receiving portion defines at least one socket, the socket substantially replicating a network cable socket, wherein the receiving portion has a larger cross section than the insert portion where the insert portion is coupled to the receiving portion to create at least one ridge to prevent the receiving portion from being inserted into the port; and the body being configured to prevent an operating connection between the network cable and the network device.

8. The cable terminator of claim 7, wherein the at least one member has a rectangular prism shape with substantially similar dimensions to a transceiver.

9. The cable terminator of claim 7, wherein the at least one socket is shaped substantially similar to a LC-type socket.

10. The cable terminator of claim 7, wherein the member is configured to be received by a LC-type socket.

11. A method of terminating a network cable comprising:

forming a non-operable connection between a network device and a network cable by:

inserting an insert portion of a cable terminator into a port, the insert portion shaped to be securely received in the port on the network device, the insert portion comprising at least one member sized substantially similar to a conventional operable connector;

inserting a connector portion of a network cable into a receiving portion of the cable terminator shaped to receive the connector portion of the network cable, wherein the receiving portion has a larger cross section than the insert portion where the insert portion is coupled to the receiving portion to create at least one ridge to prevent the receiving portion from being inserted into the port; and wherein the cable terminator prevents an operating connection between the network cable and the network device.

* * * * *